US006684456B2

(12) United States Patent
Lee

(10) Patent No.: US 6,684,456 B2
(45) Date of Patent: Feb. 3, 2004

(54) HINGE APPARATUS TO OPEN AND CLOSE AN UPPER MEMBER USED IN AN OFFICE MACHINE

(75) Inventor: Dong-gyoo Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/164,387

(22) Filed: Jun. 10, 2002

(65) Prior Publication Data

US 2003/0115719 A1 Jun. 26, 2003

(30) Foreign Application Priority Data

Dec. 21, 2001 (KR) ..... 2001-82249

(51) Int. Cl.[7] ..... E05D 11/08

(52) U.S. Cl. ..... 16/342; 16/325; 16/335; 16/286

(58) Field of Search ..... 16/242, 239, 286, 16/335, 325

(56) References Cited

U.S. PATENT DOCUMENTS 3,851,354 A * 12/1974 Anderson ..... 16/331
4,114,236 A * 9/1978 Vandervort ..... 16/335
5,077,864 A * 1/1992 Kawasaki ..... 16/278
5,479,678 A * 1/1996 Reed et al. ..... 16/325
5,513,420 A * 5/1996 Kennedy ..... 16/289
5,655,261 A * 8/1997 Cress ..... 16/286
5,937,062 A * 8/1999 Sun et al. ..... 16/303
6,351,373 B1 * 2/2002 Le et al. ..... 16/325
6,415,477 B1 * 7/2002 Hosaka et al. ..... 16/327
6,463,627 B1 * 10/2002 Hirtsiefer ..... 16/286
6,530,122 B1 * 3/2003 Kondou et al. ..... 16/335

FOREIGN PATENT DOCUMENTS

EP 599255 A1 * 6/1994 ..... E05D/11/10

* cited by examiner

*Primary Examiner*—Anthony Knight
*Assistant Examiner*—Christoopher J. Boswell
(74) *Attorney, Agent, or Firm*—Staas & Halsey LLP

(57) ABSTRACT

A hinge apparatus to open and to close an upper member such as an automatic document feeder or an upper cover used in an office machine has an upper hinge fixed on the upper member, a lower hinge fixed at a main body of the office machine, a hinge shaft to rotatably support the upper and lower hinges with respect to each other, and a position-fixing member to fix the upper member in at least one position opened at a predetermined angle by restraining the upper and lower hinges from rotating with respect to each other when the upper member is opened. The position fixing member has a first fixing part to restrain the rotation of the upper and lower hinges from a direction perpendicular to an axis of the hinge shaft and a second fixing part to restrain the rotation of the upper and lower hinges from an axis direction of the hinge shaft. Accordingly, the hinge apparatus can not only provide a compact and simple structure, but also prevent the upper member from unexpectedly falling and closing by its own weight during opening thereof, since it has a structure which can restrain the rotation of the upper and lower hinges from the axis direction of the hinge shaft as well as the direction perpendicular to the axis of the hinge shaft.

21 Claims, 8 Drawing Sheets

HINGE APPARATUS TO OPEN AND CLOSE AN UPPER MEMBER USED IN AN OFFICE MACHINE

CROSS-REFERENCE TO RELATED APPLICATIONS

This application claims the benefit of Korean Application No. 01-82249, filed Dec. 21, 2001, in the Korean Industrial Property Office, the disclosure of which is incorporated herein by reference.

BACKGROUND OF THE INVENTION

1. Field of the Invention

The present invention relates to an automatic document or paper feeder (referred to below as an automatic document feeder) applied to office machines such as a multifunction printer, a facsimile machine, a copier, etc., and more particularly, to a hinge apparatus to open and close an upper member such as the automatic document feeder used in the office machine, which can prevent the upper member from unexpectedly closing during the opening thereof.

2. Description of the Related Art

Generally, an office machine such as a facsimile machine, a multifunction printer and the like comprises a scanning apparatus to scan data recorded in a document, a facsimile apparatus to transmit the scanned data or receive data through a communication circuit, and a printing apparatus to print or output the scanned data, the data received through the communication circuit, or data inputted from a computer on a printing paper. Among these components, the scanning apparatus is an apparatus essential to transmit the data recorded in the document through the communication circuit or print them on the printing paper.

Referring to FIG. 1, there is illustrated a general scanning apparatus 1 which is used in an office machine such as a multifunction printer, a facsimile machine, and the like. The scanning apparatus 1 comprises an automatic document feeder 2 to automatically transport a document D into the inside thereof. The automatic document feeder 2 has a document-storing frame 5 to store the document D disposed at an upper part of the office machine and pick-up and transport rollers 6 and 6' to pick up and transport the document D, a scanner 8 to read data from the document D transported through the automatic document feeder 2, a white roller 8' to make the document D come into contact with the scanner 8, and a document-discharging part 9 to discharge the document D transported through the scanner 8 and the white roller 8' to the outside of the document feeder 2.

As illustrated in FIG. 2, in the automatic document feeder 2, the components therein are generally disposed to be opened and closed by two hinge apparatuses 10 and 10' mounted between a lower frame 3 of the automatic document feeder 2 and a main frame 4 of the main body of the office machine, so that attaching and detaching the document feeder 2 to and from the main body of the office machine or removing a jam generated therein during scanning of document can be easily carried out.

As illustrated in FIG. 3, FIG. 4 and FIG. 5, a conventional hinge apparatus 10 or 10' comprises a fixing frame 16 having projected brackets 19 and 19' secured with screws 20 and 20' on fixing bosses 14 and 14' formed at one side of a lower surface of the lower frame 3 of the automatic document feeder 2, a hinge body 26 inserted and settled in mounting grooves 41 and 41' formed at the main frame 4 and having supporting guides 27 and 27' projected upward from both sides of an upper part thereof, and a hinge shaft 11 having a fixing end 12 extended through a penetrated bore 18 of the fixing frame 16 and support holes 28 and 28' in the supporting guides 27 and 27' and then secured with an C-shaped ring 36 to rotatably support the fixing frame 16 and the hinge body 26 with respect to each other.

To prevent the automatic document feeder 2 from unexpectedly falling and closing by its own gravity when it is opened, the hinge apparatus 10 or 10' is provided with a position-fixing member. The position-fixing member is composed of a position-fixing cam 17 integrally formed with the fixing frame 16 and having a penetrated bore 18 to receive the hinge shaft 11 and cam surfaces 21, 21' and 22, a position-fixing plate 23 to maintain a position of the fixing frame 16 and guiding a movement thereof by engaging with the cam surfaces 21, 21' and 22 of the position-fixing cam 17, and an elastic spring 25 to elastically press the position-fixing plate 23 against the position-fixing cam 17.

The cam surfaces 21, 21' and 22 of the position-fixing cam 17 include first and second fixing cam surfaces 21 and 21' formed as flat surfaces and a guide cam surface 22 formed as a curved surface. An upper surface of the position-fixing plate 23 is formed into a flat surface, so that it can be in face-to-face contact with the first and second fixing cam surfaces 21 and 21' to restrain the movement of the fixing frame 16 when engaged therewith and in sliding contact with the guide cam surface 22 when engaged therewith.

Also, the position-fixing plate 23 and the elastic spring 25 are inserted and supported in a receiving opening 29 formed between the supporting guides 27 and 27' of the hinge body 26, and the receiving opening 29 at a lower part thereof is stopped with a support cover 31 having a protrusion 32 to support the elastic spring 25. The support cover 31 is fixed to the hinge body 26 by screws 33 and 33'.

Operation of the hinge apparatus 10 and 10' described above will now be explained.

As illustrated in FIG. 4, assuming that the lower frame 3 of the automatic document feeder 2 is closed against the main frame 4 of the main body, the position-fixing plate 23 is positioned in the position engaged with the first cam surface 21 of the position-fixing cam 17 by the elastic spring 25 to maintain the lower frame 3 in a closed position.

In this state, when one side end of the lower frame 3 is separated from the main frame 4 and raised by a user, for example, to remove a jammed document, the position-fixing cam 17 is rotated counterclockwise about the hinge shaft 11 supported in the support holes 28 and 28' of the supporting guides 27 and 27', and thereby the position-fixing plate 23 is separated from the first cam surface 21 of the position-fixing cam 17 and slid to come into contact with the curved guide cam surface 22.

When the lower frame 3 of the automatic document feeder 2 is further rotated and almost vertically positioned, the position-fixing plate 23 is engaged with the second fixing cam surface 21'. At this time, since the upper surface of the position-fixing plate 23 and the second fixing cam surface 21' are elastically engaged with each other with the aid of the elastic spring 25 by a nip on the top of the position-fixing plate 23 having a certain length and width, the automatic document feeder 2 is prevented from freely falling and closing as long as there is no external force applied thereto. Thereafter, when an end of the fixing frame 16 is engaged with a corresponding side face of the hinge body 26, the lower frame 3 is not rotated any longer and the automatic document feeder 2 is maintained in an opened position.

Operation of closing the automatic document feeder 2 is carried out in the reverse order to the operation explained above.

However, to solve problems such as when the automatic document feeder 2 is unexpectedly closed during opening thereof, the conventional hinge apparatus 10 and 10' as explained above should have the structure such that the elastic spring 25 presses the position-fixing plate 23 against the position-fixing cam 17 having the cam surfaces 21 and 21', 22 in the form of curved and flat surfaces, i.e., the structure such that the elastic spring 25 entirely prevents the automatic document feeder 2 from unexpectedly falling and closing by its own weight. Accordingly, the elastic spring 25 should be designed to have an elastic force strong enough to endure the whole weight of the automatic document feeder 2. Thus, to ensure that the elastic spring 25 has the sufficient elastic force, the size of the elastic spring 25 should be enlarged, or the number of elastic springs 25 should be increased. However, this in turn results in a problem that a size of the hinge apparatus is enlarged. If the size of the hinge apparatus is enlarged, manufacturing costs are not only increased, but also applying the hinge apparatus to small office machines requiring a compact structure is almost impossible.

SUMMARY OF THE INVENTION

Accordingly, it is an object of the present invention to provide an improved hinge apparatus to open and close an upper member used in an office machine which can not only provide a compact and simple structure, but also can prevent the upper member from unexpectedly falling and closing during opening thereof, by elastically restraining the rotation of the upper and lower hinges from an axis direction of the hinge shaft as well as a direction perpendicular to an axis of the hinge shaft.

Additional objects and advantages of the invention will be set forth in part in the description which follows and, in part, will be obvious from the description, or may be learned by practice of the invention.

The foregoing and other objects of the present invention may be achieved by providing a hinge apparatus to open and close an upper member such as an automatic document feeder or an upper cover used in an office machine, comprising: an upper hinge fixed on the upper member; a lower hinge fixed at a main body of the office machine; a hinge shaft to rotatably support the upper and lower hinges with respect to each other; and a position-fixing member to fix the upper member in at least one position opened at a predetermined angle by restraining the upper and lower hinges from rotating with respect to each other when the upper member is opened, the position fixing member having a first fixing part to restrain the rotation of the upper and lower hinges from a direction perpendicular to an axis of the hinge shaft and a second fixing part to restrain the rotation of the upper and lower hinges from an axis direction of the hinge shaft.

In an embodiment of the present invention, the first fixing part comprises: a position-fixing cam integrally formed with one of the upper and lower hinges and having at least one cam surface; a position-fixing plate member to maintain the upper member in the position opened at the predetermined angle by engaging with the cam surface of the position-fixing cam when the upper member is opened at the predetermined angle; and at least one first elastic spring disposed between the position-fixing plate member and the other of the upper and lower hinges to elastically press the position-fixing plate member toward the cam surface of the position-fixing cam.

The position-fixing cam is integrally formed with the upper hinge and provided with a penetrated bore to receive and support the hinge shaft, first and second fixing cam surfaces, and a guide cam surface, and the position-fixing plate member comprises at least one position-fixing plate having an upper surface to engage with the cam surfaces of the position-fixing cam to settle the position of the upper member or guide the movement thereof. In another aspect of the present invention, the first and second fixing cam surfaces of the position-fixing cam and the upper surface of the position-fixing plate are formed as flat surfaces, respectively, and the guide cam surface is formed as a curved surface. In another aspect, each of the first and second fixing cam surfaces of the position-fixing cam and the upper surface of the position-fixing plate are formed respectively as concave and convex surfaces to settle the position of the upper member.

The second fixing part comprises: a movement body coaxially disposed with the hinge shaft in the penetrated bore of the position-fixing cam to receive and support the hinge shaft, and formed to be movable in the axis direction by one of hinge shaft supporters formed at both sides of the other of the upper and lower hinges when the upper member is opened; a rotation-restraining brake coaxially disposed with the hinge shaft in the penetrated bore of the position-fixing cam to restrain the rotation of the upper and lower hinges about the hinge shaft by pressing the other of the hinge shaft supporters through the position-fixing cam of one of the upper and lower hinges according to the movement of the movement body; and a second elastic spring disposed between the movement body and the rotation-restraining brake to elastically press the movement body and the rotation-restraining brake toward the corresponding hinge shaft supporters, respectively.

The second fixing part can further include an engaged operation portion to make the movement body be engaged and moved with the position-fixing cam, and an axis operation portion to make the movement body movable in the axis direction by one of the hinge shaft supporters when the upper member is opened. The engaged operation portion comprises at least one slide projection formed at one end of either the movement body or the penetrated bore of the position-fixing cam, and at least one projection-receiving groove formed corresponding to the at least one projection on the other surface of either the movement body or the penetrated bore of the position-fixing cam.

The axis operation portion comprises at least one slide projection formed to be projected as much as the given distance which the second elastic spring is to be pressed by the movement body, at one end of either the movement body or one of the hinge shaft supporters, and a slide projection-receiving groove formed corresponding to the slide projection at the other end of either the movement body or one of the hinge shaft supporters, to enable the movement body to move in the axis direction of the hinge shaft by engaging with the slide projection when the upper member is rotated.

The movement body is formed in a cylindrical shape having a first penetrated bore formed in an inner diameter corresponding to a diameter of the hinge shaft toward one of the hinge shaft supporters to receive the hinge shaft, and a second penetrated bore formed toward the other of the hinge shaft supporters to pass the hinge shaft and support the second elastic spring.

The rotation-restraining brake is formed in a cylindrical shape having a third penetrated bore formed toward one of the hinge shaft supporters to pass the hinge shaft and support the second elastic spring, and a fourth penetrated bore formed in the inner diameter corresponding to the diameter of the hinge shaft toward the other of the hinge shaft supporters to receive the hinge shaft.

The upper hinge comprises a fixing frame having projected brackets screwed on fixing bosses formed at one side of a lower surface of the upper member.

The lower hinge comprises a hinge body settled in a mounting groove formed in the main body of the office machine and having a receiving opening to receive and support the position-fixing plate member and the first elastic spring.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF PREFERRED EMBODIMENTS

Figure 1:
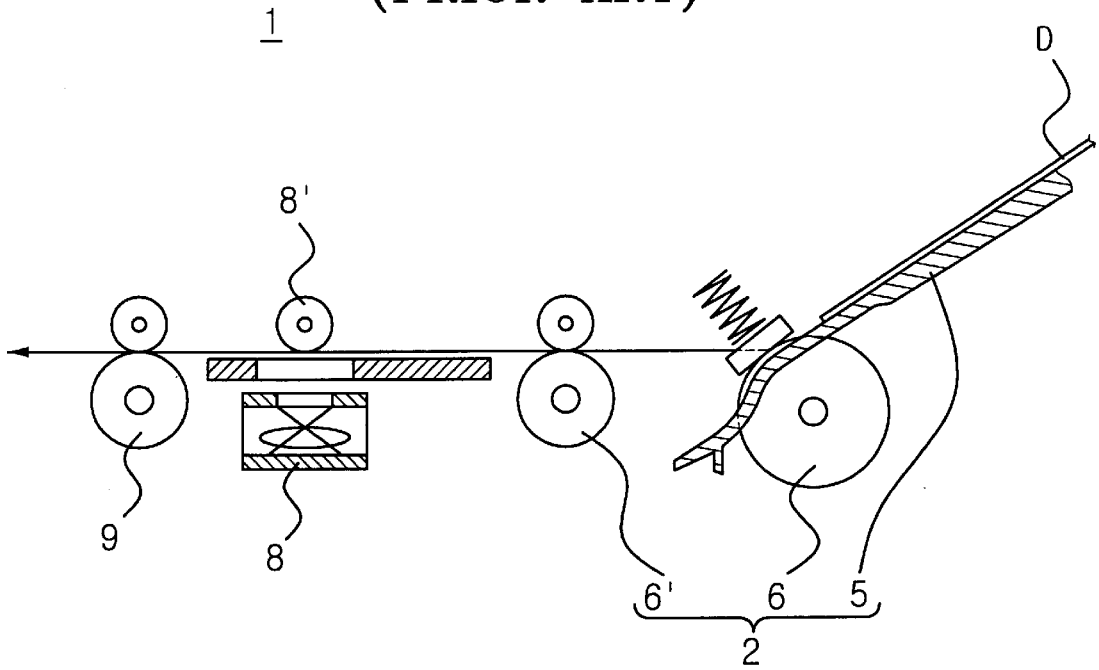
FIG. 1 (PRIOR ART)
FIG. 1 is a schematic diagram of a scanning apparatus of a general office machine.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 6:
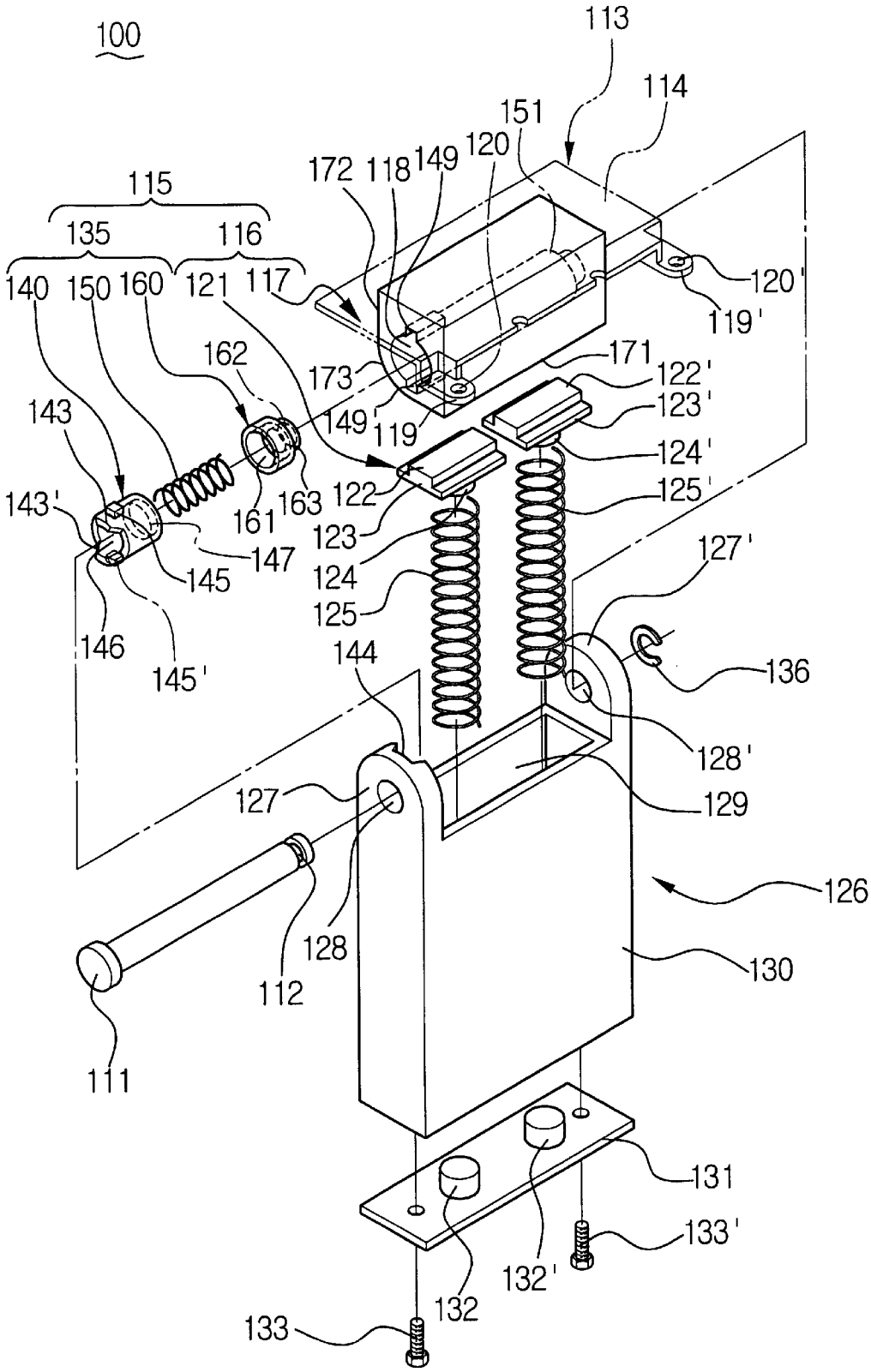
FIG. 6 is an exploded perspective view of a hinge apparatus to open and close an automatic document feeder in accordance with an embodiment of the present invention.

Referring now to FIG. 6, there is illustrated a hinge apparatus 100 to open and close an automatic document feeder 2 used in a multifunction printer in accordance with an embodiment of the present invention.

Figure 2:
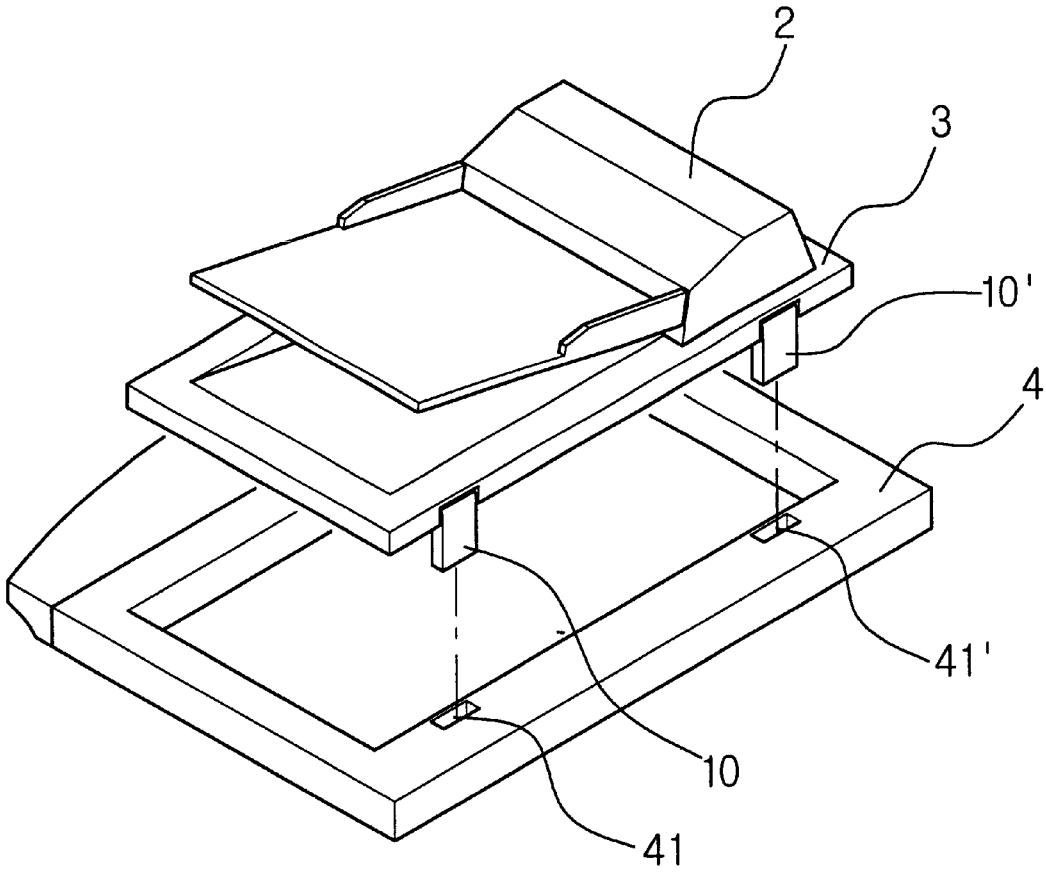
FIG.2 (PRIOR ART)
FIG. 2 is a partial perspective view of the general office machine of FIG. 1 to which a conventional hinge apparatus to open and close an automatic document feeder is applied.
Figure 3:
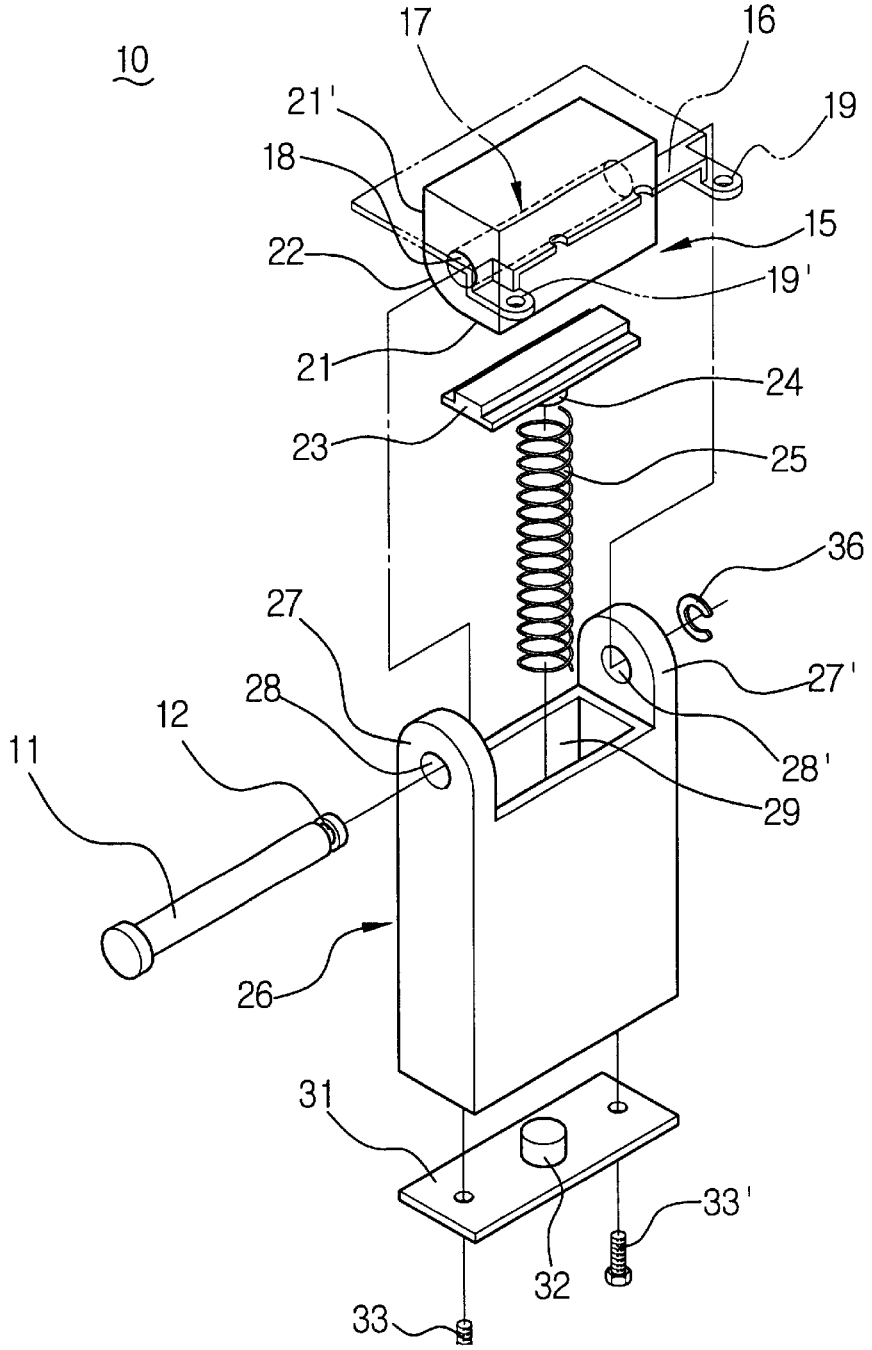
FIG.3 (PRIOR ART)
FIG. 3 is an exploded perspective view of the conventional hinge apparatus of FIG. 1.
Figure 4:
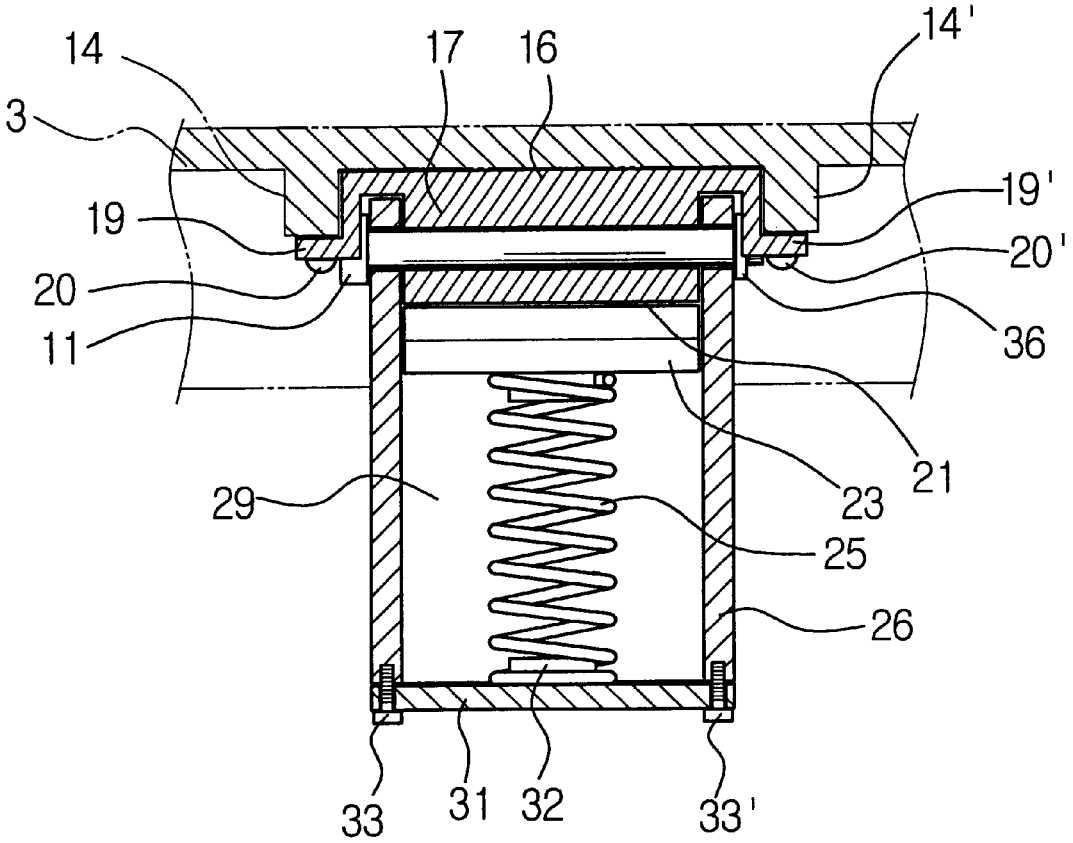
FIG.4 (PRIOR ART)
FIG. 4 is a cross-sectional view of the conventional hinge apparatus illustrated in FIG. 3 when it is in a closed position.
Figure 5:
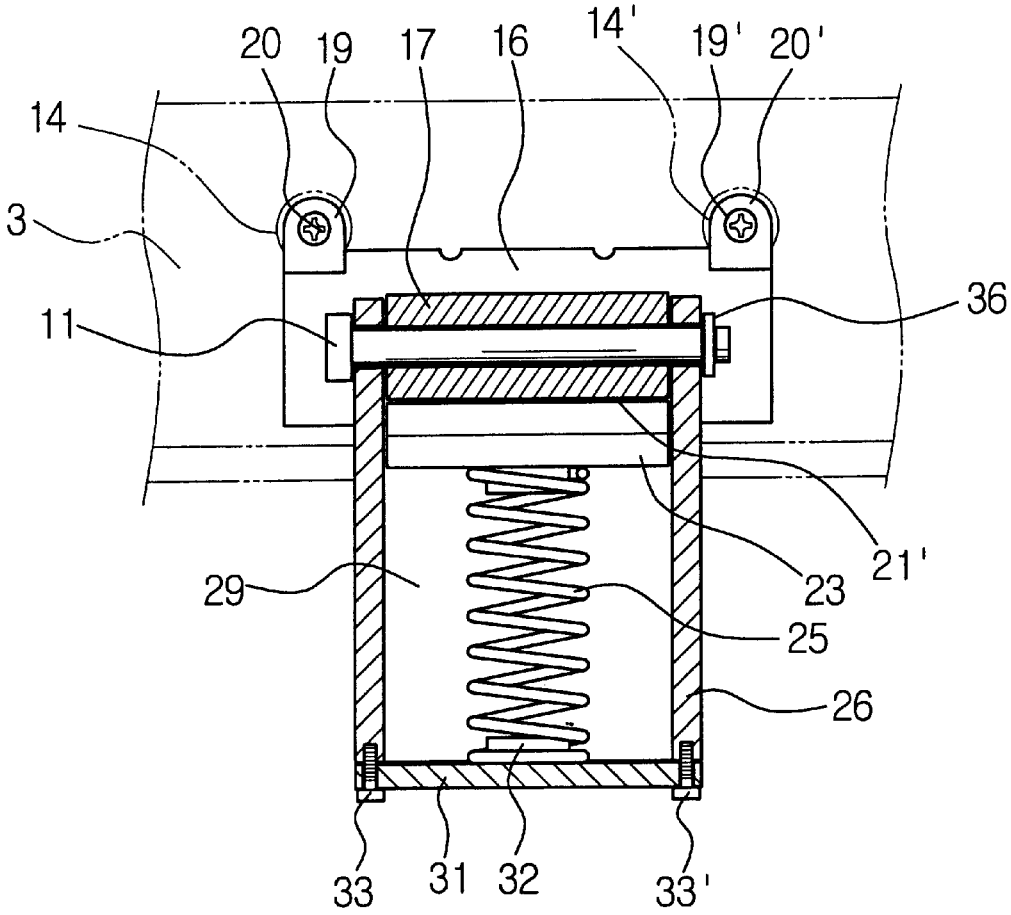
FIG.5 (PRIOR ART)
FIG. 5 is a cross-sectional view of the conventional hinge apparatus illustrated in FIG. 3 when it is in an opened position.

The hinge apparatus 100 of the present invention includes an upper hinge 113 fixed on a lower frame 3 (see FIG. 2) of the automatic document feeder 2, a lower hinge 126 settled in mounting grooves 41 and 41' (see FIG. 2) of a main body 4 of the multifunction printer, a hinge shaft 111 to rotatably support the upper and lower hinges 113 and 126 with respect to each other to open and close the automatic document feeder 2, and a position-fixing member 115 to restrain the upper and lower hinges 113 and 126 from rotating with respect to each other and thereby preventing the automatic document feeder 2 from unexpectedly falling and closing by its own weight when the automatic document feeder 2 is opened.

The upper hinge 113 comprises a fixing frame 114 having projection brackets 119 and 119' screwed on fixing bosses 14 and 14' (FIG. 7) formed at one side of a lower surface of the lower frame 3 of the automatic document frame 2.

The lower hinge 126 comprises a hinge body 130 secured in mounting grooves 41 and 41' formed at one side of the main body 4 of the multifunction printer by a fixing member such as screws. The hinge body 130 has a receiving opening 129 to receive and support a position-fixing plate member 121 and first elastic springs 125 and 125' of a position-fixing member 115 as will be described below.

The receiving opening 129 of the hinge body 130 at a lower part thereof is stopped with a support cover 131 having protrusions 132 and 132' to support the first elastic springs 125 and 125'. The support cover 131 is fixed to the hinge body 130 by screws 133 and 133'.

At both sides of a top end of the hinge body 130, first and second hinge shaft supporting guides 127 and 127', in which support holes 128 and 128' to receive and support the hinge shaft 111 are respectively formed, are disposed.

To rotatably support the upper and lower hinges 113 and 126 with respect to each other, the hinge shaft 111 is extended through the support holes 128 and 128' of the first and second hinge shaft supporting guides 127 and 127' and a penetrated bore 118 of a position-fixing cam 117 of the position-fixing member 115 as will be described below. The hinge shaft 111 has an C-shaped ring 136 fixed in an C-shaped ring-receiving groove 112, so that it can rotatably secure the upper and lower hinges 113 and 126 together.

The position fixing member 115 of the invention comprises a first fixing part 116 to elastically restrain the rotation of the upper and lower hinges 113 and 126 from a direction perpendicular to an axis of the hinge shaft 111 and a second fixing part 135 to strain the rotation of the upper and lower hinges 113 and 126 from an axis direction of the hinge shaft 111.

The first fixing part 116 comprises a position-fixing cam 117 integrally formed with the upper hinge 113, a position-fixing plate member 121 to maintain the automatic document feeder 2 in the position opened at a predetermined angle, for example 900, by engaging with the position-fixing cam 117 when the automatic document feeder 2 is opened at the predetermined angle, and the two first elastic springs 125 and 125' disposed in the receiving opening 129 of the lower hinge 126 to elastically press the position-fixing plate member 121 against the position-fixing cam 117.

The position-fixing cam 117 has a penetrated bore 118 to receive and support the hinge shaft 111, which is formed along a central axis thereof, and first and second fixing cam surfaces 171 and 172 and a guide cam surface 173 which are formed at an outer surface thereof. The first and second fixing cam surfaces 171 and 172 of the position-fixing cam 117 are formed as flat surfaces, whereas the guide cam surface 173 is formed as a curved surface. Alternatively, the first and second fixing cam surfaces 171 and 172 can be formed as concave or grooved surfaces.

The position-fixing plate member 121 comprises two supporting plates 123 and 123'. The supporting plates 123 and 123' have upper surfaces 122 and 122' to engage with the cam surfaces 171, 172 and 173 of the position-fixing cam 117 to settle the position of the automatic document feeder 2 or guide the movement thereof, and protrusions 124 and 124' to support the first elastic springs 125 and 125', respectively. In an aspect of the present invention, upper surfaces 122 and 122' of the supporting plates 123 and 123' forming the position-fixing plate member 121 are formed as flat surfaces, but in the case that the first and second fixing cam surfaces 171 and 172 of the position-fixing cam 117 are formed as concave or grooved surfaces, the upper surfaces 122 and 122' can be formed as corresponding convex surfaces.

Figure 7:
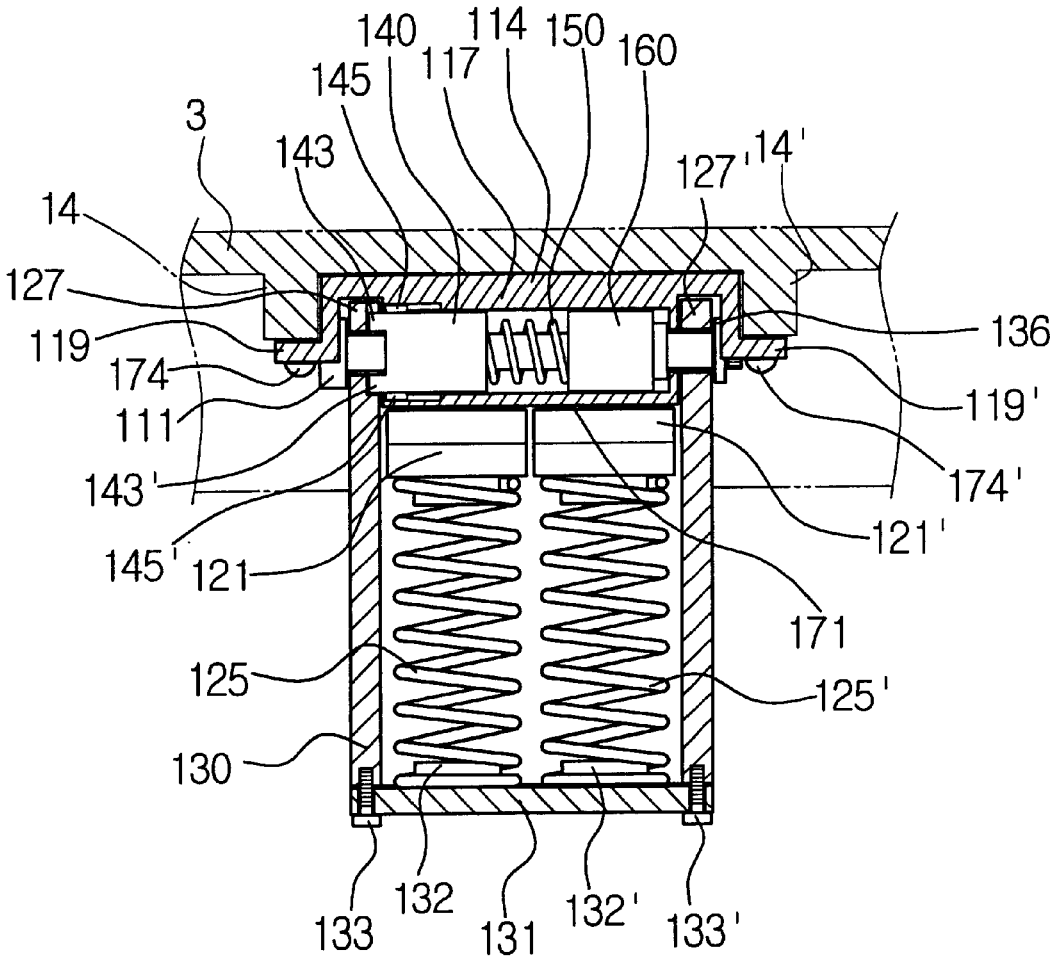
FIG. 7 is a cross-sectional view of the hinge apparatus of the embodiment of the present invention illustrated in FIG. 6 when it is in a closed position.

Accordingly, during opening of the automatic document feeder 2, when the fixing frame 114 of the upper hinge 113 is in the fully counterclockwise position about the hinge shaft 111 from a position illustrated in FIG. 7, the upper surfaces 122 and 122' of the supporting plates 123 and 123' of the position fixing plate member 121, which are elastically pressed by the first elastic springs 125 and 125', are disengaged from the first fixing cam surface 171 by a counterclockwise rotation force of the position-fixing cam 117, and then slid into contact with the guide cam surface 173.

Figure 8:
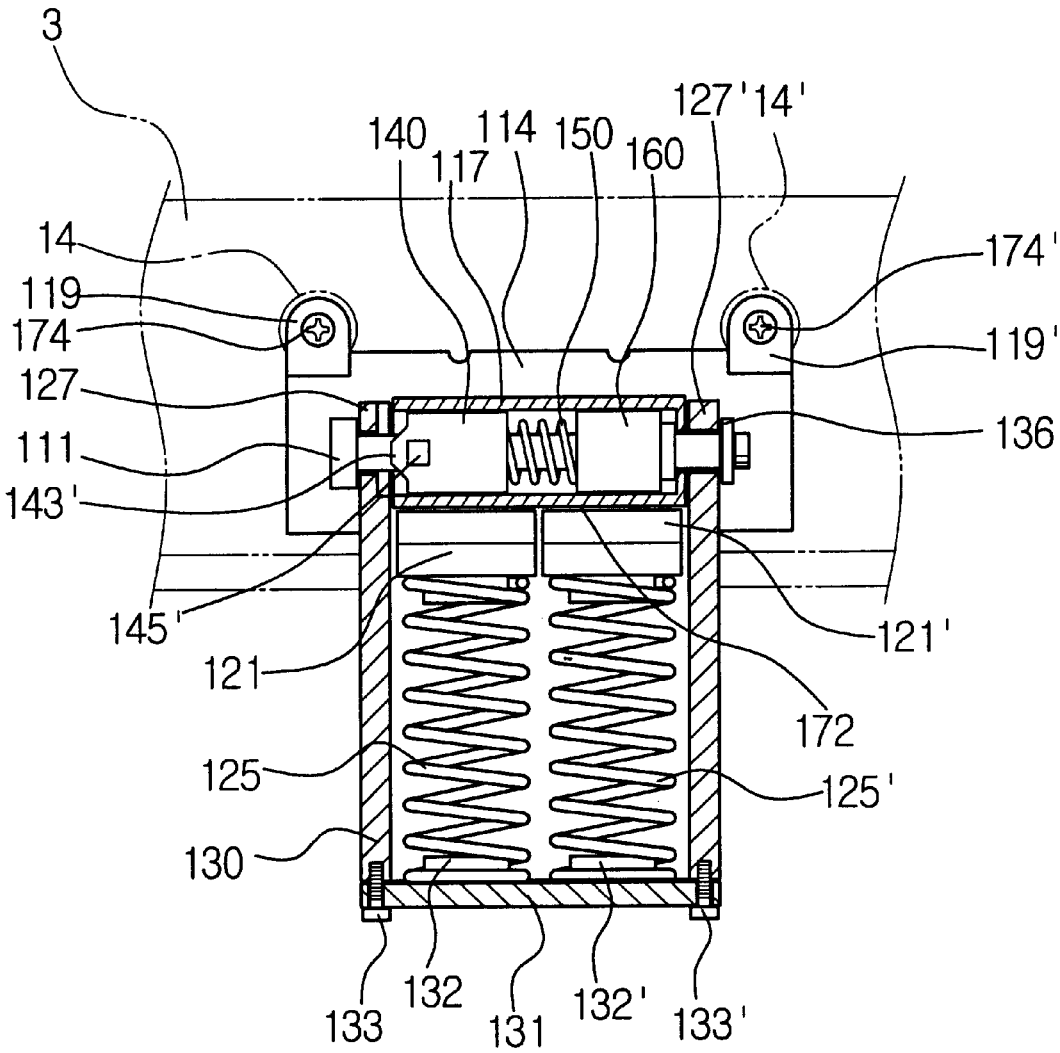
FIG. 8 is a cross-sectional view of the hinge apparatus of the embodiment the present invention illustrated in FIG. 6 when it is in an opened position.

In this state, when the fixing frame 114 of the upper hinge 113 is further rotated and almost vertically positioned according to the rotation of the automatic document feeder 2, the upper surfaces 122 and 122' of the supporting plates 123 and 123' are separated from the guide cam surface 173 and engaged with the second fixing cam surface 172, as illustrated in FIG. 8.

At this time, since the second fixing cam surface 172 and the upper surfaces 122 and 122' of the supporting plates 123 and 123' are engaged with each other by a nip of the upper surfaces 122 and 122' having a predetermined length and width of the upper surfaces 122 and 122', the automatic document feeder 2 can be prevented from falling and closing by its own weight. Particularly, at this time, in the case that the second fixing cam surface 172 and the upper surfaces 122 and 122' of the supporting plates 123 and 123' are respectively formed as concave and convex surfaces, the automatic document feeder 2 can be more fixedly supported.

In contrast, during closing of the automatic document feeder 2, when the fixing frame 114 of the upper hinge 113 is rotated clockwise about the hinge shaft 111 from a position illustrated in FIG. 8, the upper surfaces 122 and 122' of the supporting plates 123 and 123' are disengaged from the second fixing cam surface 172 by a clockwise rotation force of the position-fixing cam 117, and slid into contact with the guide cam surface 173. In this state, when the fixing frame 114 of the upper hinge 113 is further rotated and almost horizontally positioned according to the rotation of the automatic document feeder 2, the upper surfaces 122 and 122' of the supporting plates 123 and 123' are separated from the guide cam surface 173 and engaged again with the first fixing cam surface 171. At this time, since the first fixing cam surface 171 and the upper surfaces 122 and 122' of the supporting plates 123 and 123' are engaged with each other at the nip of the upper surfaces 122 and 122' having the predetermined length and width, the automatic document feeder 2 is maintained in a closed position.

Here, it should be noted that in the embodiment of the invention described above, the position-fixing cam 117 is explained as having only two fixing cam surfaces 171 and 172 formed to maintain the automatic document feeder 2 in the closed and opened positions in cooperation with the supporting plates 123 and 123', but can also be formed to have additional fixing cam surfaces to maintain the automatic document feeder 2 in other certain positions other than the closed position and the opened position.

Referring again to FIG. 6 the second fixing part 135, to restrain the rotation of the upper and lower hinges 113 and 125 from the axis direction of the hinge shaft 111, comprises a movement body 140 coaxially disposed with the hinge shaft 111 in the penetrated bore 118 of the position-fixing cam 117 to receive and support the hinge shaft 111 and formed to be movable in the axis direction by the first hinge shaft supporting guide 127 of the hinge body d130 when the automatic document 2' is opened, a ration-restraining brake 160 coaxially disposed with the hinge shaft 111 in the penetrated bore 118 of the position-fixing cam 117 to restrain the rotation of the upper and lower hinges 113 and 126 about the hinge shaft 111 by pressing the second hinge shaft supporting guide 127' through the position-fixing cam 117 according to the movement of the movement body 140, and a second elastic spring 150 disposed between the movement body 140, and a second elastic spring 150 disposed between the movement body 140 and the rotation-restraining brake 160 to elastically press the movement body 140 and the rotation-restraining brake 160 toward the first and second hinge shaft supporting guides 127 and 127', respectively.

The movement body 140 is formed in a hollow and cylindrical shape having a first penetrated bore 146 formed in an inner diameter corresponding to a diameter of the hinge shaft 111 toward the first hinge shaft supporting guide 127 to pass the hinge shaft 111, and a second penetrated bore 147 formed toward the second hinge shaft supporting guide 127' to pass the hinge shaft 111 and support the second elastic spring 150.

The rotation-restraining brake 160 is formed in a hollow and cylindrical shape having a third penetrated bore 161 formed toward the first hinge shaft supporting guide 127 to pass the hinge shaft 111 and support the second elastic spring 150, and a fourth penetrated bore 162 formed in the inner diameter corresponding to the diameter of the hinge shaft 111 toward the second hinge shaft supporting guide 127' to pass the hinge shaft 111.

An end of the rotation-restraining brake 160 positioned against the second hinge shaft supporting guide 127' is disposed to be in contact with a humped end of the penetrated bore 118 of the position-fixing cam 117 positioned against the second hinge shaft supporting guide 127'.

The second fixing part 135 further includes an engaged operation portion 145, 145', 149 and 149' to make the movement body 140 be engaged and moved with the position-fixing cam 117, and an axis operation portion 143, 143' and 144 to make the movement body 140 be movable in the axis direction by the first hinge shaft supporting guide 127 of the hinge body 130 when the automatic document feeder 2 is opened or closed.

The engaged operation portion comprises two projections 145 and 145' formed at an outer surface of the movement body 140, and two elongated projection-receiving grooves 149 and 149' formed corresponding to the projections 145 and 145' in the penetrated bore 118 of the position-fixing cam 117.

The axis operation portion comprises slide projections 143 and 143' formed at an end of the movement body 140 against the first hinge shaft supporting guide 127 to be projected as much as the given distance which the second elastic spring 150 is to be pressed by the movement body 140, and a slide projection-receiving groove 144 formed corresponding to the slide projections 143 and 143' at an inner surface of the first hinge shaft supporting guide 127, to enable the movement body 140 to move in the axis direction of the hinge shaft 111 by engaging with the slide projections 143 and 143' when the automatic document feeder 2 is rotated, i.e., opened or closed. The slide projections 143 and 143' and the slide projection-receiving groove 144 respectively have inclined surfaces formed at each of both side edges thereof. The inclined surfaces function to ensure that both side edges of the slide projections 143 and 143' and the slide projection-receiving groove 144 are easily engaged to come into sliding contact with each other when the automatic document feeder 2 is rotated.

Accordingly, when the fixing frame 114 of the upper hinge 113 is rotated counterclockwise about the hinge shaft 111 as the automatic document feeder 2 is opened, the movement body 140, which is engaged with the position fixing cam 117 of the fixing frame 114 through the engaged operation portion 145, 145', 149 and 149', is also rotated counterclockwise. As a result, the slide projections 143 and 143' of the axis operation portion formed at the movement body 140 are rotated counterclockwise, and thereby moved right with the inclined surfaces thereof coming in contact with the corresponding inclined surfaces of the slide projection-receiving groove 144 formed at the first hinge shaft supporting guide 127 of the hinge body 130 (FIG. 8). As the slide projections 143 and 143' are moved right, the movement body 140 is also moved right, and thereby the elastic spring 150 is elastically pressed to push the rotation-restraining brake 160 right. As the rotation-restraining brake 160 is pushed right, the end 163 of the rotation-restraining brake 160 presses the humped end 151 of the penetrated bore 118 of the position-fixing cam 117 against the second hinge shaft supporting guide 127'.

In this state, when the fixing frame 114 of the upper hinge 113 is further rotated and almost vertically opened by the rotation of the automatic document feeder 2, a right end of the position-fixing cam 117 comes in contact with the second hinge shaft supporting guide 127' to restrain the rotation of the upper and lower hinges. At this time, since the second fixing cam surface 172 and the upper surfaces 122 and 122' of the supporting plates 123 and 123' are also engaged with each other by the nip in the upper surfaces 122 and 122' having the predetermined length and width, the automatic document feeder 2 can be doubly prevented from freely falling and closing by its own weight.

In contrast, when the fixing frame 114 of the upper hinge 113 is rotated clockwise about the hinge shaft 111 as the automatic document feeder 2 is closed, the movement body 140 engaged with the position fixing cam 117 of the fixing frame 114 through the engaged operation portion 145, 145', 149 and 149' is also rotated clockwise. As a result, the slide projections 143 and 143' of the axis operation portion formed at the movement body 140 are rotated clockwise, and thereby moved left and inserted into the slide projection-receiving groove 144 (FIG. 7). As the slide projections 143 and 143' are moved left, the movement body 140 is moved left by the elastic force of the second elastic spring 150. At this time, since the elastic spring 150 releases a force of pressing the rotation-restraining brake 160, the end 163 of the rotation-restraining brake 160 does not press the humped end 151 of the penetrated bore 118 of the position-fixing cam 117 against the second hinge shaft supporting guide 127' any longer.

In the embodiment described above, it should be noted that the hinge apparatus 100 is explained as applied only in rotatably fixing the automatic document feeder 2 to the main body 4 of the multifunction printer, but the invention is not limited thereto. For example, the hinge apparatus 100 of the invention may also be applied in rotatably fixing other components such as an upper cover and the like to the main body 4.

Operation of a hinge apparatus 100 to open and close an automatic document feeder used in an office machine in accordance with the present invention will now be explained with reference to FIG. 6 through FIG. 8.

Assuming that a lower frame 3 of an automatic document feeder 2 is closed, as illustrated in FIG. 7, when the automatic document feeder 2 is opened, a fixing frame 114 of an upper hinge 113 is rotated counterclockwise about a hinge shaft 111.

At this time, upper surfaces 122 and 122' of supporting plates 123 and 123', elastically pressed by first elastic springs 125 and 125', are disengaged from a first fixing cam surface 171 by a counterclockwise rotation force of the position-fixing cam 117 and slid into contact with a guide cam surface 173.

Also, a movement body 140, engaged with the position-fixing cam 117 of the fixing frame 114 through an engaged operation portion 145, 145', 149 and 149' is rotated counterclockwise. Consequently, slide projections 143 and 143' of an axis operation portion are also rotated counterclockwise and thereby moved right with inclined surfaces thereof coming into contact with corresponding inclined surfaces of a slide projection-receiving groove 144. As the slide projections 143 and 143' are moved right, the movement body 140 is also moved right, and thereby a second elastic spring 150 is elastically pressed to push a rotation-restraining brake 160 right. Accordingly, one end 163 of the rotation-restraining brake 160 presses a humped end 151 of a penetrated bore 118 of the position-fixing cam 117 against a second hinge shaft supporting guide 127'.

In this state, when the fixing frame 114 of the upper hinge 113 is further rotated and almost vertically positioned by the rotation of the automatic document feeder 2, the upper surfaces 122 and 122' of the supporting plates 123 and 123' are completely separated from the guide cam surface 173 and engaged with the second fixing cam surface 172, as illustrated in FIG. 8.

At this time, since the second fixing cam surface 172 and the upper surfaces 122 and 122' of the supporting plates 123 and 123' are engaged with each other by the first elastic springs 125 and 125', and also a right end of the position-fixing cam 117 comes in tight contact with a second hinge shaft supporting guide 127' to restrain the rotation of the upper and lower hinges, the automatic document feeder 2 can be doubly prevented from unexpectedly falling and closing by its own weight.

In contrast, when the fixing frame 114 of the upper hinge 113 is rotated clockwise about the hinge shaft 111 from a position illustrated in FIG. 8 as the automatic document feeder 2 is closed, the upper surfaces 122 and 122' of the supporting plates 123 and 123' are disengaged from the second fixing cam surface 172 by the clockwise rotation force of the position-fixing cam 117 and slid into contact with the guide cam surface 173.

At this time, the movement body 140, engaged with the position fixing cam 117 of the fixing frame 114 through the engaged operation portion 145, 145', 149 and 149', is rotated clockwise. Accordingly, the slide projections 143 and 143' are rotated clockwise and thereby moved left to be inserted into the slide projection-receiving groove 144, as illustrated in FIG. 7. As the slide projections 143 and 143' are moved left, the movement body 140 is moved left by the elastic force of the second elastic spring 150. At this time, since the elastic spring 150 releases a force of pressing the rotation-restraining brake 160, the end 163 of the rotation-restraining brake 160 does not press the humped end 151 of the penetrated bore 118 of the position-fixing cam 117 against the second hinge shaft supporting guide 127' any longer, and the upper and lower hinges 113 and 126 are released from the elastic force of the second elastic spring 150, thereby becoming freely rotated.

In this state, when the fixing frame 114 of the upper hinge 113 is further rotated and almost horizontally positioned by the rotation of the automatic document feeder 2, the upper surfaces 122 and 122' of the supporting plates 123 and 123' are again separated from the guide cam surface 173 and engaged again with the first fixing cam surface 171. At this time, since the first fixing cam surface 171 and the upper surfaces 122 and 122' of the supporting plates 123 and 123' are engaged with each other by a nip of the upper surfaces 122 and 122' having a predetermined length and width, the automatic document feeder 2 is maintained in a closed position.

As apparent from the foregoing description, it can be appreciated that the hinge apparatus of the present invention can not only provide a compact and simple structure, but can also prevent the upper member from unexpectedly falling and closing by its own weight during opening thereof since it has the structure which can restrain the rotation of the upper and lower hinges from the axis direction of the hinge shaft as well as the direction perpendicular to the axis of the hinge shaft.

Although a few embodiments of the present invention have been shown and described, it will be appreciated by those skilled in the art that changes may be made in these embodiments without departing from the principles and spirit of the invention, the scope of which is defined in the claims and the equivalents.

What is claimed is:

1. A hinge apparatus to open and close an upper member used in an office machine, comprising:

an upper hinge fixed on the upper member;

a lower hinge fixed at a main body of the office machine;

a hinge shaft to rotatably support the upper and lower hinges with respect to each other; and a position-fixing member to fix the upper member in at least one position opened at a predetermined angle by restraining the upper and lower hinges from rotating with respect to each other when the upper member is opened, the position fixing member having a first fixing part to restrain the rotation of the upper and lower hinges from a direction perpendicular to an axis of the hinge shaft and a second fixing part to restrain the rotation of the upper and lower hinges from an axis direction of the hinge shaft.

2. The apparatus according to claim 1, wherein the first fixing part comprises:

a position-fixing cam integrally formed with one of the upper and lower hinges and having at least one cam surface;

a position-fixing plate member to maintain the upper member in the position opened at the predetermined angle by engaging with the cam surface of the position-fixing cam when the upper member is opened at the predetermined angle; and at least one first elastic spring disposed between the position-fixing plate member and one of the upper and lower hinges to elastically press the position-fixing plate member against the cam surface of the position-fixing cam.

3. The apparatus according to claim 2, wherein the position-fixing cam comprises a penetrated bore to receive and support the hinge shaft, a guide cam surface, and first and second fixing cam surfaces located at different positions along said guide cam surface, the position-fixing cam being integrally formed with the upper hinge; and wherein the position-fixing plate member comprises at least one position-fixing plate having an upper surface to engage with the cam surfaces of the position-fixing cam to settle the position of the upper member or guide the movement thereof.

4. The apparatus according to claim 3, wherein the first and second fixing cam surfaces of the position-fixing cam and the upper surface of the position-fixing plate are formed as flat surfaces, respectively, and the guide cam surface is formed as a curved surface.

5. The apparatus according to claim 3, wherein each of the first and second fixing cam surfaces of the position-fixing cam are formed as concave surfaces, and the upper surface of the position-fixing plate is formed as a convex surface.

6. The apparatus according to claim 3, wherein the second fixing part comprises:

a movement body coaxially disposed with the hinge shaft in the penetrated bore of the position-fixing cam to receive and support the hinge shaft, and formed to be movable in the axis direction by one of two hinge shaft supporters, each hinge shaft supporter formed at one side of either the upper or lower hinge when the upper member is opened;

a rotation-restraining brake coaxially disposed with the hinge shaft in the penetrated bore of the position-fixing cam to restrain the rotation of the upper and lower hinges about the hinge shaft by pressing the other of the hinge shaft supporters through the position-fixing cam of one of the upper and lower hinges according to the movement of the movement body; and a second elastic spring disposed between the movement body and the rotation-restraining brake to elastically press the movement body and the rotation-restraining brake toward the corresponding hinge shaft supporters, respectively.

7. The apparatus according to claim 6, wherein the second fixing part further comprises:

an engaged operation portion to make the movement body be engaged and moved with the position-fixing cam; and an axis operation portion to make the movement body movable in the axis direction by one of the hinge shaft supporters when the upper member is opened.

8. The apparatus according to claim 7, wherein the engaged operation portion comprises:

at least one projection formed on a surface of one of the movement body and the penetrated bore of the position-fixing cam; and at least one projection-receiving groove formed corresponding to the projection on the other surface of the one of the movement body and the penetrated bore of the position-fixing cam.

9. The apparatus according to claim 8, wherein the axis operation portion comprises:

at least one slide projection formed to be projected as much as the given distance which the second elastic spring is to be pressed by the movement body, at one end of the one of the movement body and one of the hinge shaft supporters; and a slide projection-receiving groove formed corresponding to the slide projection at the other end of either the movement body or one of the hinge shaft supporters, to enable the movement body to move in the axis direction of the hinge shaft by engaging with the slide projection when the upper member is rotated.

10. The apparatus according to claim 9, wherein the movement body is formed in a cylindrical shape having a first penetrated bore formed in an inner diameter corresponding to a diameter of the hinge shaft toward one of the hinge shaft supporters to pass the hinge shaft, and a second penetrated bore formed toward the other of the hinge shaft supporters to pass the hinge shaft and support the second elastic spring; and wherein the rotation-restraining brake is formed in a cylindrical shape having a third penetrated bore formed toward one of the hinge shaft supporters to pass the hinge shaft and support the second elastic spring, and a fourth penetrated bore formed in the inner diameter corresponding to the diameter of the hinge shaft toward the other of the hinge shaft supporters to pass the hinge shaft.

11. The apparatus according to claim 10, wherein the upper hinge comprises a fixing frame having projected brackets screwed on fixing bosses formed at one side of a lower surface of the upper member.

12. The apparatus according to claim 11, wherein the lower hinge comprises:

a hinge body settled in a mounting groove formed at the main body of the office machine and having a receiving opening to receive and support the position-fixing plate member and the first elastic spring.

13. The hinge apparatus according to claim 1, wherein the upper member is an automatic document feeder.

14. The hinge apparatus according to claim 1, wherein the upper member is an upper cover.

15. A hinge apparatus to open and close a movable member on an office machine, comprising:

an upper hinge member having a guide cam surface thereof, a fixing frame to support the movable member, and a position fixing member to fix a position of the upper hinge member, the position fixing member located at the guide cam surface and at the center of the upper hinge member;

a lower hinge member connected to the office machine and to the upper hinge member; and a hinge shaft to rotatably connect the upper and lower hinges.

16. The hinge apparatus according to claim 15, wherein the position fixing member comprises:

a first fixing part to elastically restrain the rotation of the upper hinge member with respect to the lower hinge member; and a second fixing part to restrain the rotation of the upper hinge member with respect to the lower hinge member from the a position of the axis of rotation of the upper hinge member.

17. The hinge apparatus according to claim 16, wherein the first fixing part comprises:

a pair of position fixing plate members, each having a respective elastic spring extending from the lower hinge member and forcing the respective position fixing plate member against the guide cam surface to restrict the rotation thereof.

18. The hinge apparatus according to claim 17, wherein the second fixing part comprises:

a movement body, a second elastic spring and a rotation restraining brake each positioned within the center of the upper hinge member and around the hinge shaft such that the rotation restraining brake supports the position of the second elastic spring within the upper hinge member to bias the movement body again the lower hinge member to restrain the rotation of the upper hinge member.

19. The hinge apparatus according to claim 18, wherein the movement body comprises slide projections formed at one end thereof to elastically engage with the lower hinge member to restrain rotation of the upper hinge member.

20. The hinge apparatus according to claim 19, wherein the lower hinge member comprises:

first and second hinge shaft supporting guides to support the hinge shaft, the first hinge shaft supporting guide having slide projection engaging grooves receiving the slide projections to restrain rotation of the upper hinge member.

21. The hinge apparatus according to claim 17, wherein each position fixing plate member comprises a convex surface to engage with one of several concave surfaces of the position fixing cam to engage with the position fixing cam and elastically restrain rotation of the upper hinge member.

* * * * *